US007100664B2

(12) United States Patent
Hsu

(10) Patent No.: US 7,100,664 B2
(45) Date of Patent: Sep. 5, 2006

(54) BLIND SLAT CONTROL MECHANISM

(75) Inventor: Ben Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 235 days.

(21) Appl. No.: 10/885,631

(22) Filed: Jul. 8, 2004

(65) Prior Publication Data

US 2005/0274465 A1 Dec. 15, 2005

(30) Foreign Application Priority Data

May 28, 2004 (TW) ..... 93208455 U

(51) Int. Cl.
*E06B 9/303* (2006.01)

(52) U.S. Cl. ..... 160/115; 160/168.1 R

(58) Field of Classification Search ..... 160/168.1 R, 160/173 R, 180, 178.3, 178.1 R, 176.1 R, 160/177 R, 113, 115, 116
See application file for complete search history.

(56) References Cited

U.S. PATENT DOCUMENTS 2,673,607 A * 3/1954 Rulfs ..... 160/115
3,294,153 A * 12/1966 Fountain ..... 160/168.1 R
4,593,738 A * 6/1986 Chi Yu ..... 160/176.1 R
5,143,135 A * 9/1992 Kuhar ..... 160/107
5,934,351 A * 8/1999 Bharucha et al. ..... 160/176.1 R
2006/0021716 A1* 2/2006 Liang ..... 160/168.1 R

* cited by examiner

*Primary Examiner*—Blair M. Johnson
(74) *Attorney, Agent, or Firm*—Troxell Law Office, PLLC

(57) ABSTRACT

A blind slat control mechanism include a pair of first rope ladders mounted between an upper and tower beams of a Venetian blind for a plurality of slats to be equidistantly abutted against for location thereby, and the upper ends of the rope ladders are wound through adjustment rollers of mounting seats adapted at both inner sides of the upper beam to control the rotation of the slats in different angles thereby. A pull cord, led through cord-passage holes of each slat, is wound through a pulley seat mounted at one end of the upper beam to control the folding or unfolding operation of the slats thereby. A sliding guide plate is disposed at the corresponding side of both mounting seats thereof for a second rope ladder and a driving cord to be fixedly attached thereto respectively. The second rope ladder, bestriding the bottom-most slat thereof in an U-shaped form, has a plurality of positioning steps alternatively astride the slats in odd or even number. A hook ring and a pivoting hole are disposed at the other end of the upper beam for the driving cord to pass and suspend downwards there-from. Thus, via the linkage operation of the sliding guide plates with both the second rope ladders and the driving cord fixedly attached thereto, the driving cord is simply pulled to actuate the movement of the sliding guide plates and synchronically draw upwards the second rope ladders therewith in an easy and fast manner, effectively avoiding the slant of the slats due to uneven pulling force applied thereto to achieve the best using condition thereof.

5 Claims, 5 Drawing Sheets

BLIND SLAT CONTROL MECHANISM

BACKGROUND OF THE INVENTION

The present invention is related to a blind-slat control mechanism, including a pair of first rope ladders mounted between an upper and lower beams of a Venetian blind for a plurality of slats to be equidistantly abutted against for location thereby, and the upper ends of the first rope ladders are located at mounting seats adapted at both inner lateral sides of the upper beam to control the rotation of the slats in different angles thereby. A pull cord, led through cord-passage holes of each slat, is wound through a pulley seat disposed at one end of the upper beam to control the folding or unfolding operation of the slats thereby. Sliding guide plates are disposed at the corresponding side of both mounting seats thereof for a pair of second rope ladders and a driving cord to be fixedly attached thereto respectively, and the second rope ladders, each bestriding the bottommost slat thereof in a U-shaped form, have a plurality of positioning steps alternatively astride the slats in odd or even number. A hook ring and a pivoting hole are disposed at the other end of the upper beam for the driving cord to pass and suspend downwards there-from; whereby, via the linkage operation thereof, the driving cord is simply pulled to actuate the movement of the sliding guide plates and synchronically draw upwards the second rope ladders therewith in an easy and fast manner, effectively avoiding the slant of the slats due to uneven pulling force applied thereto to achieve the best using condition thereof.

Please refer to FIG. 1. A conventional blind slat control mechanism is made up of a Venetian blind 10 having a first rope ladder 11 and a second rope ladder 12 sequentially mounted to a plurality of slats 13 and respectively bestriding a lower beam 14 into U-shaped forms. Positioning slide posts 151 and a first and second pulley seats 152, 153 are respectively disposed at both ends of an upper beam 15 for both ends of the first and second rope ladders to wind there-through and extend downwards there-from. In practical use, the first rope ladder 11 is pulled downwards to draw up the odd-numbered or even-numbered slats 13, piling up the slats 13 in pairs to augment the light-passable space as shown in FIG. 2. When the second rope ladder 12 is pulled downwards, the slats 13 will keep gathering up from bottom to top in a sequence. A mounting seat with an adjustment member is adapted inside the upper beam 15 for retaining another rope ladder (without shown in the diagram) to adjust the rotation of the slats 13 in different angles.

There are some drawbacks to such conventional blind slat control mechanism. First, the first and the second rope ladders 11, 12 are suspended downwards from the same side of the upper beam 15. In practical use, it's easy to misjudge the two rope ladders 11, 12 and mix up the two in operation. Besides, in case pulling force is unevenly applied onto both ends of the first or the second rope ladders 11, 12, the slats 13 can easily get tilted and cause the inconvenience in operation thereof. Second, the first rope ladder 11 is wound through the lower beam 14 thereof. In case of a great pulling force applied thereto, the first rope ladder 11 tends to raise upwards the lower beam 14 and sequentially gather up each slat 13 from bottom to top, losing the function to pile up the slats 13 in pairs. Thus, the operation of the first rope ladder 11 thereof is more difficult to control. Third, the first rope ladder 11, winding through the inner side of the lower beam 14, must first actuate the lower beam 14 before extending through the first pulley seat 152 to suspend downwards there-from, which can waste quite a lot of efforts and pains in the operation thereof. Fourth, the two positioning slide posts 151 and first/second pulley seats 152, 153 are mounted inside the upper beam 15 thereof for the first and the second rope ladders 11, 12 to wind there-through, which can increase the cost of material and make the assembly thereof more troublesome and tedious.

SUMMARY OF THE PRESENT INVENTION

It is, therefore, the primary purpose of the present invention to provide a blind slat control mechanism wherein a pair of sliding guide plates are disposed at the corresponding side of mounting seats adapted inside an upper beam for a pair of second rope ladders and a driving cord to be fixedly attached thereto respectively in linkage operation; whereby, the driving cord is simply pulled to actuate the movement of the sliding guide plates and synchronically draw upwards the second rope ladders therewith in an easy and fast manner, effectively avoiding the slant of the slats due to uneven pulling force applied thereto. Besides, the driving cord and a pull cord are individually mounted at either end of the upper beam, refraining from the misjudgment of both cords in operation thereof so as to achieve the best using condition thereof.

It is, therefore, the second purpose of the present invention to provide a blind slat control mechanism wherein the driving cord is equipped with a locating stop member to be abutted against either a retaining cavity of a pivoting hole or a hook ring of the upper beam thereof relative to the operation of the driving cord for limiting location thereby, and each second rope ladder, extending downwards to bestride the bottommost slat thereof in a U-shaped form, can refrain from actuating a lower beam therewith when pulled by the driving cord in linkage operation thereof. Via the locating stop member thereof, the driving cord is precisely stretched and located in an easy and fast manner, facilitating a more accurate operation of the second rope ladder thereof.

It is, therefore, the third purpose of the present invention to provide a blind slat control mechanism wherein the driving cord of the Venetian blind is simply pulled downwards to actuate the movement of the sliding guide plates, synchronically drawing upwards the second rope ladders and gathering up the even-numbered or odd-numbered slats therewith to provide a more easy and effortless operation thereof.

It is, therefore, the fourth purpose of the present invention to provide a blind slat control mechanism wherein, via the sliding guide plates and the hook rings in limiting abutment against the locating stop member of the driving cord thereof, the second rope ladder is precisely located and easily operated, effectively reducing the process of assembly and the cost of material as well as.

DETAILED DESCRIPTION OF THE PREFERRED EMBODIMENTS

Figure 1:
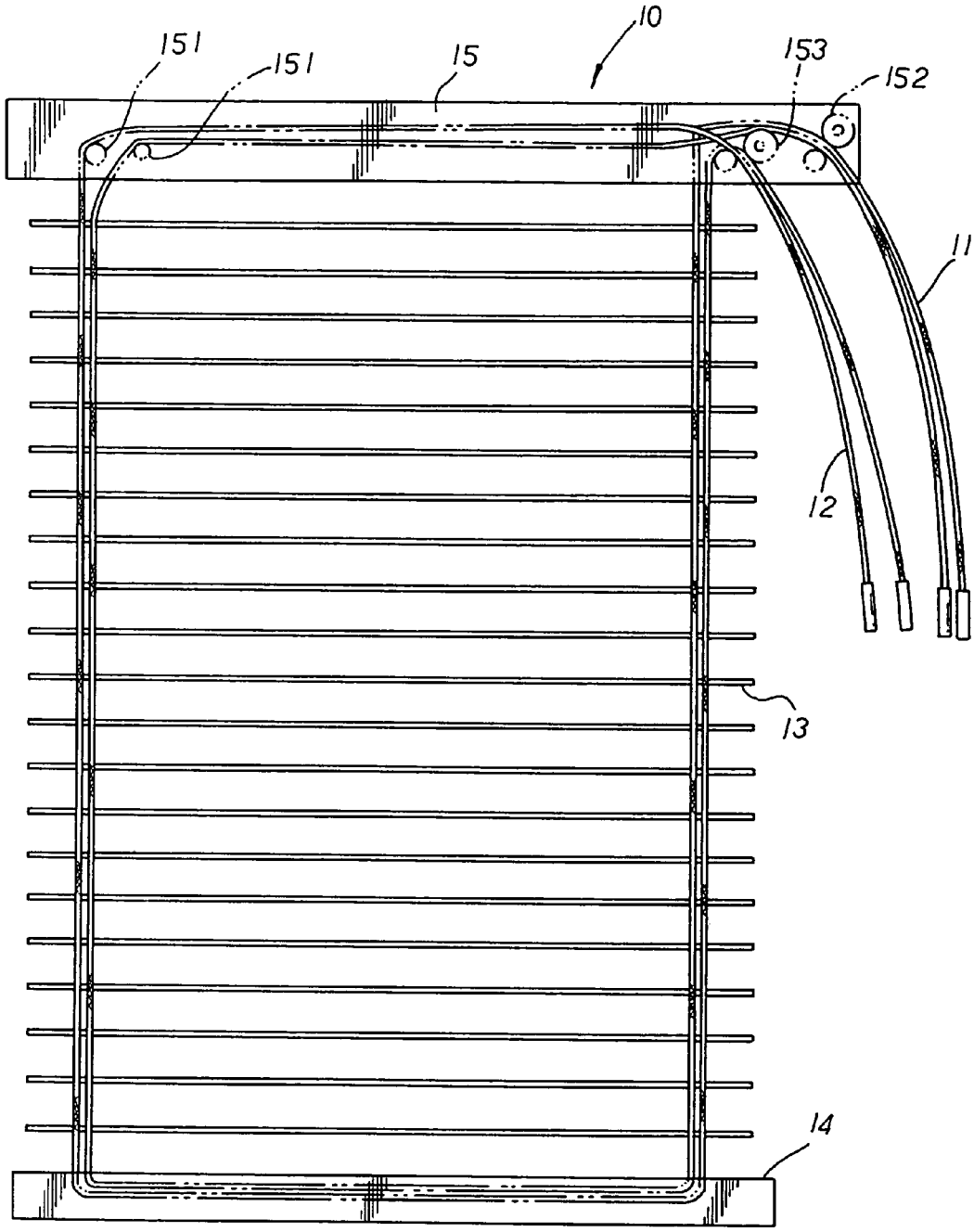
FIG. 1 PRIOR ART
FIG. 1 is a plane view of a conventional blind slat control mechanism.
Figure 2:
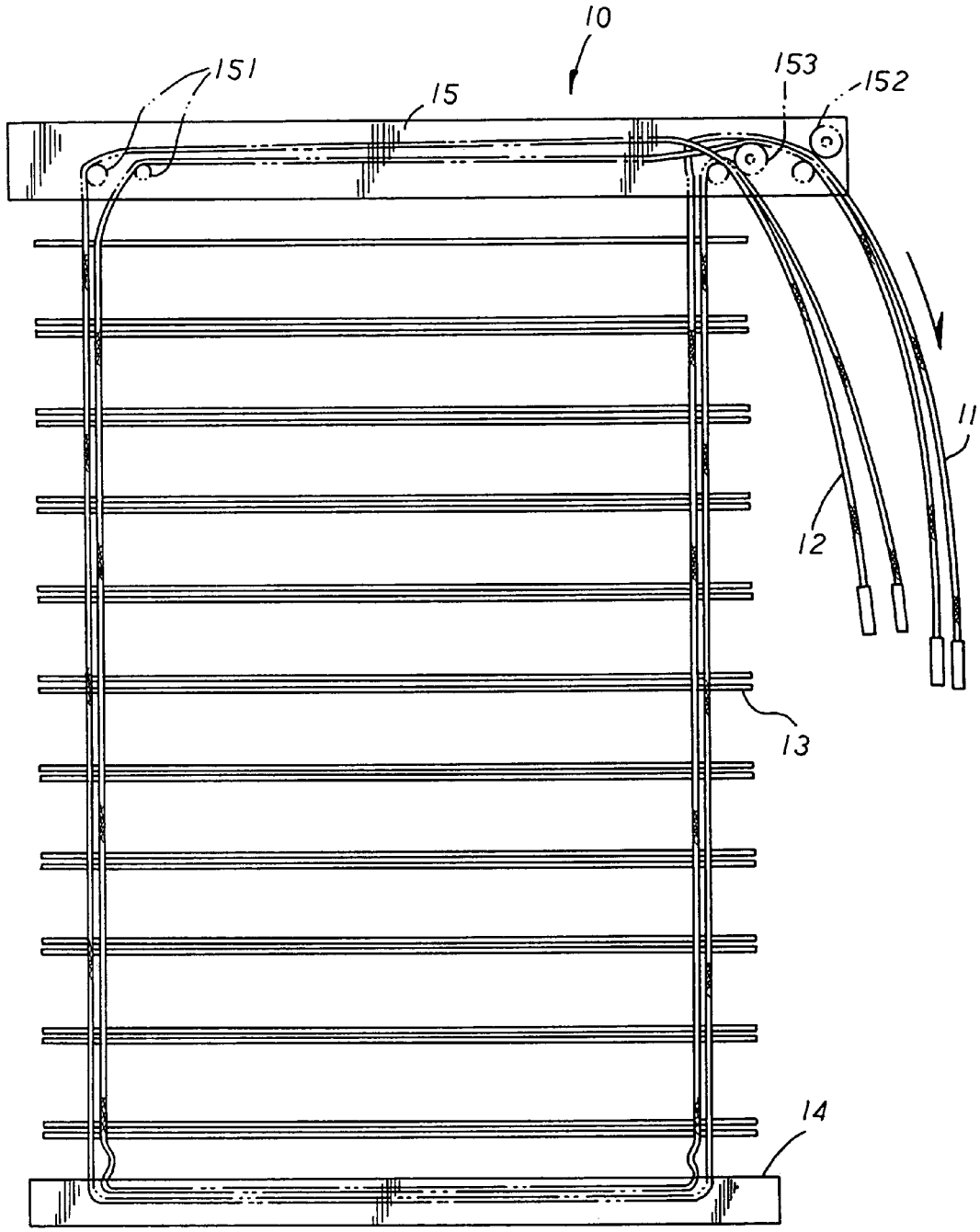
FIG. 2 PRIOR ART
FIG. 2 is a diagram showing the conventional blind slat control mechanism in practical use.
Figure 3:
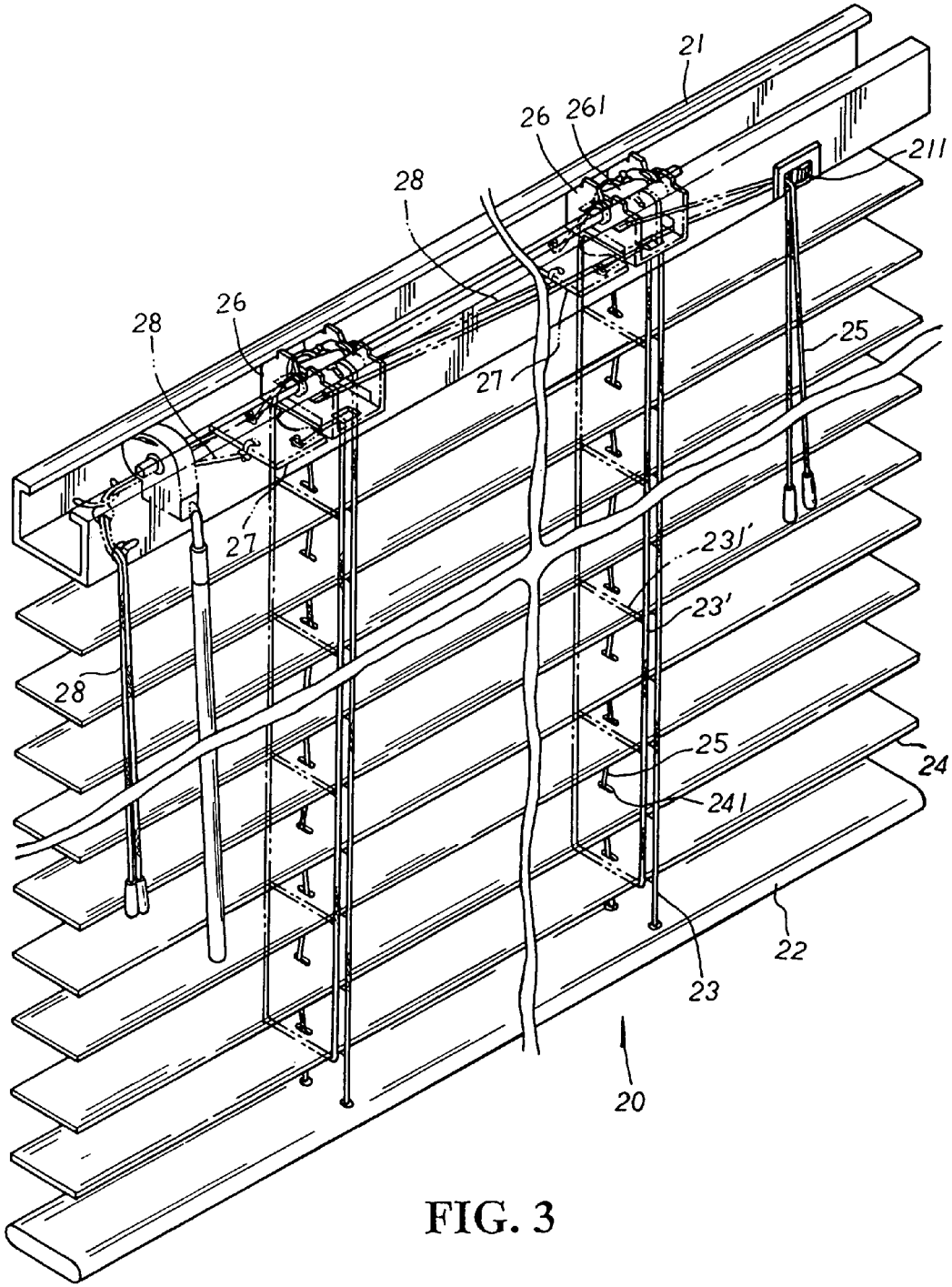
FIG. 3 is a perspective view of the present invention.
Figure 4:
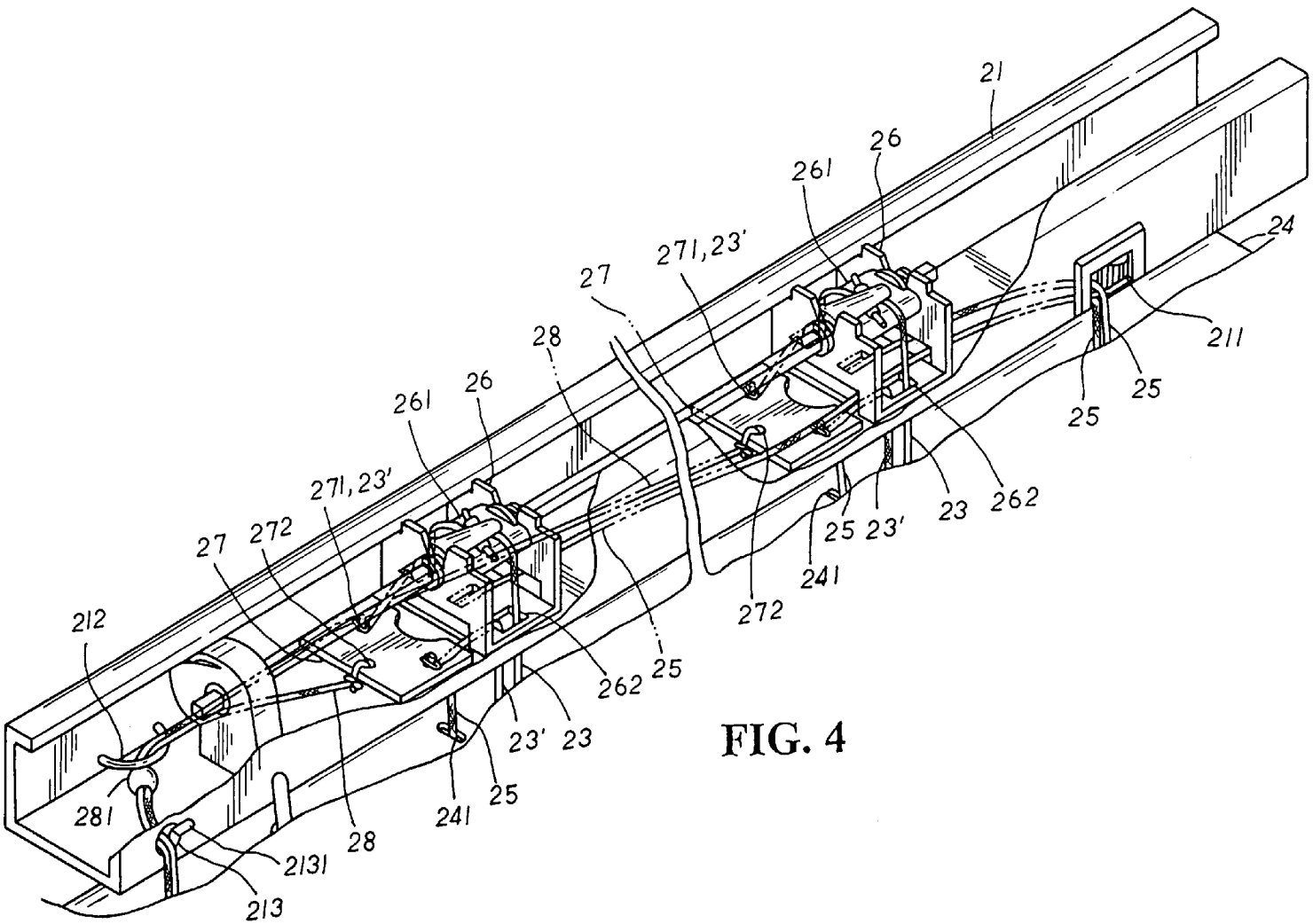
FIG. 4 is a partially enlarged and perspective view of an upper beam of the present invention.

Please refer to FIGS. 2 to 3 inclusive. The present invention is related to a blind slat control mechanism, including a Venetian blind 20 having a pair of first rope ladders 23 mounted between an upper and lower beams 21, 22 for a plurality of slats 24 to be sequentially led there-through and equidistantly abutted against for location thereby. A pull cord 25 is pivotally led through cord-passage holes 241 symmetrically disposed at both sides of each slat 24 thereof, and the upper ends of the pull cord 25 thereof are wound through a pulley seat 211 mounted at one end of the upper beam 21 to suspend downwards there-from. The upper ends of first rope ladders 23 are wound and located at adjustment rollers 261 of mounting seats 26 adapted at both inner lateral sides of the upper beam 21 to control the rotation of the slats 24 in different angles thereby. At the corresponding side of both mounting seats 26 is respectively joined a sliding guide plate 27 that is equipped with two linkage holes 271 and a driving hole 272 at the preset spots thereon for a second rope ladder 23' and a driving cord 28 to be fixedly attached thereto at one ends thereof. The second rope ladder 23', led through rope-passage holes 262 of the mounting seat 26 thereof, is stretched downwards to bestride the bottommost slat 24 thereof in a U-shaped form. The second rope ladder 23' also includes a plurality of positioning steps 231' alternatively astride the slats 24 in odd or even number. An arc-shaped hook ring 212 and a pivoting hole 213 opposite to the hook ring 212 thereof are disposed at the other end of the upper beam 21 for the driving cord 28 wound through the hook ring 212 at the inner side of the upper beam 21 therein to pass through the pivoting hole 213 and suspend downwards there-from. A beaded locating stop member 281 is disposed at a preset spot of the driving cord 28 in limiting abutment against the hook ring 212 for retaining the second rope ladder 23' precisely at the position of even suspension downwards thereby. The locating stop member 281 has an outer diameter smaller than that of the pivoting hole 213, and a retaining cavity 2131 is properly cut at one side of the pivoting hole 213 thereof.

Figure 5:
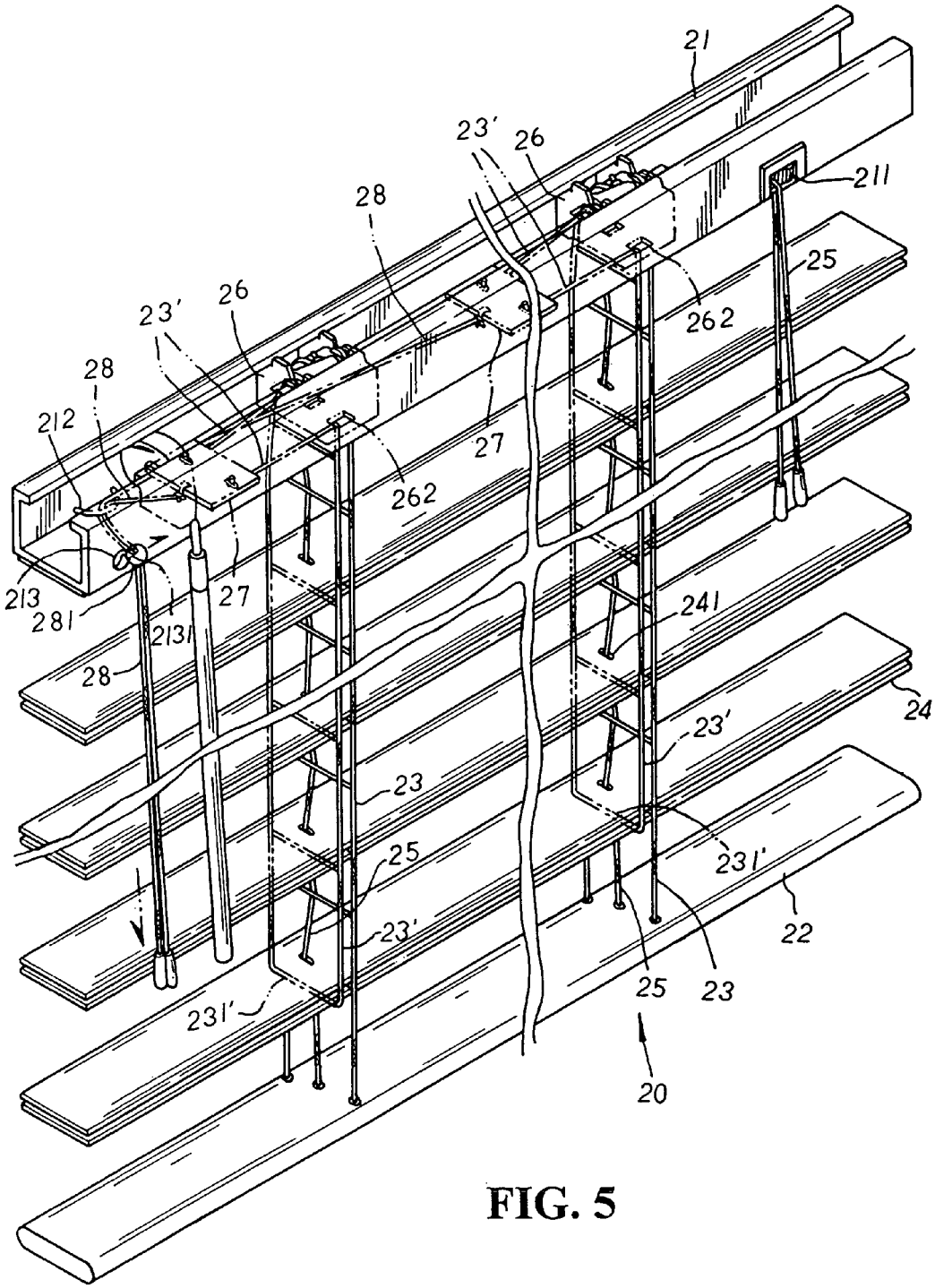
FIG. 5 is a diagram showing the present invention in practical use.

Please refer to FIG. 5. To enlarge the light-passable space of the slats 24, the driving cord 28 is pulled downwards along the hook ring 21 and the pivoting hole 213 respectively to actuate the movement of the sliding guide plates 27 therewith. The second rope ladders 23' are then drawn upwards by the sliding movement of the driving holes 271 thereof, raising upwards therewith the odd-numbered or even-numbered slats 24 abutting against the positioning steps 231' thereof to pile up with the neighboring slats 24 disposed above thereof. Meanwhile, the locating stop member 281 is led through the pivoting hole 213 to come out there-from, and the driving cord 28 is pulled sideways into the retaining cavity 2131 to abut the locating stop member 181 against the retaining cavity 2131 at the outer side thereof. Both the driving cord 28 and the locating stop member 281 are then limited at the retaining cavity 2131 thereof to precisely locate the second rope ladders 23' thereby. Thus, the slats 24 of the Venetian blind 20 are sequentially piled up in pairs to augment the light-passable space for adjusting the light coming into a room. And via linkage operation of the sliding guide plates 27 with both the second rope ladders 23' and the driving cord 28 fixedly attached thereto, the driving cord 28 is simply pulled to actuate the movement of the sliding guide plates 27 and synchronically move upwards the second rope ladders 23' therewith, avoiding the slant of the slats 24 due to uneven pulling force applied thereto, and facilitating the operation thereof in an easy and fast manner. Besides, both driving cord 28 and the pull cord 25 are individually mounted at either end of the upper beam 21, refraining from the misjudgment in operation thereof so as to achieve the best using condition thereof.

What is claimed is:

1. A blind slat control mechanism, including a Venetian blind having a pair of first rope ladders mounted between an upper and a lower beam and a plurality of slats to be sequentially led there-through and equidistantly abutted against for location thereby, and the upper ends of the first rope ladders are wound through adjustment rollers of mounting seats adapted at both inner lateral sides of the upper beam to control the rotation of the slats in different angles thereby; at least one pull cord, led through cord-passage holes of each slat, is wound and extended downwards from a pulley seat mounted at one end of the upper beam to control the folding or unfolding operation of the slats thereby; the present invention being characterized by that, a sliding guide plates each being disposed at repective sides of each mounting seat inside the upper beam thereof, and two linkage holes and a driving hole being disposed at preset spots of the sliding guide plate thereon for a second rope ladder and a driving cord to be fixedly attached thereto respectively; the second rope ladder, led through rope-passage holes of the mounting seat thereof, being stretched downwards to bestride the bottommost slat thereof in a U-shaped form and equipped with a plurality of positioning steps alternatively astride the slats in odd or even number; a pivoting hole being disposed at the other end of the upper beam for the driving cord led through the inner side of the upper beam to pass there-through and suspend downwards there-from;

thus, via the linkage operation of the sliding guide plates with both the second rope ladders and the driving cord fixedly attached thereto, the driving cord is pulled to actuate the movement of the sliding guide plates and synchronically draw upwards the alternate slats supported by the second rope ladders therewith for adjusting the light coming into a room, effectively avoiding the slant of the slats due to uneven pulling force applied thereto; the pull cord and the driving cord are individually mounted at opposite ends of the upper beam thereof.

2. The blind slat control mechanism as claimed in claim 1 wherein an arc-shaped hook ring is disposed inside the upper beam opposite to the pivoting hole thereof for the driving cord to be wound through in limiting location thereby.

3. The blind slat control mechanism as claimed in claim 1 wherein at a preset spot of the driving cord is disposed a beaded locating stop member with an outer diameter smaller than that of the pivoting hole thereof.

4. The blind slat control mechanism as claimed in claim 1 wherein the pivoting hole of the upper beam has a retaining cavity cut at one side thereof.

5. The blind slat control mechanism as claimed in claim 3 wherein the locating stop member of the driving cord is respectively limited by either the hook ring or the retaining cavity of the pivoting hole in abutting location thereby relative to the operation of the driving cord thereof.

* * * * *